US005158024A

United States Patent [19]

Tanaka et al.

[11] Patent Number: 5,158,024

[45] Date of Patent: Oct. 27, 1992

[54] COMBUSTION CONTROL APPARATUS FOR A COAL-FIRED FURNACE

[75] Inventors: Shinji Tanaka, Tokyo; Tatsuya Miyatake, Chiba; Kazuyoshi Yamamoto; Yuichi Miyamoto, both of Hyogo, all of Japan

[73] Assignee: Kawasaki Jukogyo Kabushiki Kaisha, Kobe, Japan

[21] Appl. No.: 815,800

[22] Filed: Jan. 2, 1992

[30] Foreign Application Priority Data

Mar. 26, 1991 [JP] Japan ..... 3-61655

[51] Int. Cl.[5] ..... F23N 5/18

[52] U.S. Cl. ..... 110/186; 110/185; 110/232; 110/347

[58] Field of Search ..... 110/185, 186, 188, 232, 110/347

[56] References Cited

U.S. PATENT DOCUMENTS 4,528,918 7/1985 Sato et al. ..... 110/347
4,640,204 2/1987 Williams ..... 110/347

FOREIGN PATENT DOCUMENTS 0002527 1/1983 Japan ..... 110/186
0223425 10/1986 Japan ..... 110/186

*Primary Examiner*—Edward G. Favors
*Attorney, Agent, or Firm*—Schwartz & Weinrieb

[57] ABSTRACT

This invention relates to a combustion control apparatus for a powdered coal-fired furnace that monitors noxious substances contained within the burning waste gases, unburned substances within the ash and the power data of a pulverizing mill in order to operate the combustion furnace safely and efficiently. The combustion control apparatus infers from the current states or data optimal control amounts that will maintain within the minimum allowable ranges the noxious nitrogen oxides and the in-ash unburned substances that affect the combustion efficiency-and thereby controls the combustion furnace with good stability. The combustion control apparatus qualitatively evaluates as fuzzy quantities the density data of the nitrogen oxides contained within the exhaust gases of the unburned substances contained within the ash, and the power data of the pulverizing mill. Based upon the evaluation results a fuzzy inference is formed so as to determine the optimum control amount of the two-stage combustion air ratio for minimizing the nitrogen oxides and also the optimum control amount for the fine/coarse gain separator so as to extract powdered coal of a grain size most effective for minimizing the unburned substances within the ash.

2 Claims, 3 Drawing Sheets

PROCESS OF INFERENCE
USING FUZZY REASONING

COMBUSTION CONTROL APPARATUS FOR A COAL-FIRED FURNACE

BACKGROUND OF THE INVENTION

1. Field of the Invention

The present invention relates generally to furnaces, and more particularly; to a combustion control apparatus for a powdered coal burning furnace which monitors the amounts of noxious substances contained within the burning waste gases, and the amounts of unburnt substances within the ashes, as well as the power data of a pulverizing mill so as to operate the combustion furnace safely and efficiently.

2. Description of the Prior Art

In recent years, with coal having attained a position as a viable alternative energy source with respect to oil, powdered coal burning technology for generator boilers is attracting attention. The technology itself is already an established one, in which the coal is pulverized within a pulverizing mill and the powdered coal, which is separated from coarse grains of coal by means of a fine/coarse grain separator, is injected in the form of a gas from a burner into a furnace for combustion.

FIG. 3 shows a schematic configuration of a generator boiler using a powdered coal combustion system. In the Figure, the coal deposited within a charging mechanism 10 is fed to a pulverizing mill 11 where it is pulverized by means of rollers 12 into small grains which are separated by means of a fine/coarse grain separator 13 into coarse grains and fine grains of coal. Two types of fine/coarse grain separators are available: one is a vane type that separates fine grains from coarse grains by changing the angle of the vanes and the other is a rotary type that utilizes centrifugal force for separating the fine grains from the coarse grains of coal.

The powdered fine grains of coal extracted by means of the fine/coarse separator 13 are fed together with primary air to a burner 15 of a furnace 14. The primary air serves two purposes-drying the powdered coal so as to make it easier to burn and carrying the powdered coal to the burner. The primary air accounts for 10–30 percent of the amount of air required for combustion. The remainder of the air is supplied as secondary air within the vicinity of the nozzle of the burner 15. Tertiary air may be supplied to ensure stable ignition or adjust the shape of the flame. From an appropriate position within the furnace 14 remote from the burner 15, air for a second-stage combustion (in connection with a two-stage combustion method) is supplied in the direction of the propagation of burning gas.

The two-stage combustion method supplies combustion air in two stages into the furnace 14. That is, the first-stage air (primary to tertiary air) from the burner 15 is intentionally undersupplied so as to cause incomplete combustion and produce a reducing atmosphere in order to suppress generation of nitrogen monoxide (NO), and the second-stage air (for second-stage combustion) is supplied from an appropriate location remote from the burner 15 so as to make up for the air deficiency in order to burn the fuel completely. The first and second air stages are fed from a delivery air blower 16 through an air preheater 17, with the amount of second-stage combustion air adjusted by means of a second-stage air damper 18.

Heat generated by means of the furnace 14 is transmitted to water passing through an evaporator tube 19 by means of radiation or through contact with gases, thereby evaporating the water. The burning gas is passed through the air preheater 17 where the heat of the burning gas is collected, and is then discharged by means of a suction air blower 20 from a stack 21.

In operation of the boiler, it is necessary to minimize the amount of noxious emissions from the burning gases such as, for example, nitrogen oxides $NO_x$ and sulfur oxides $SO_x$ to a level which is within an allowable range while at the same time improving the combustion efficiency. It is especially noted that with those boilers using coal as a fuel, the rate of combustion is far slower than those boilers or furnaces which use oil and gas as their fuels, and therefore the temperature of the furnace tends to be reduced, which in turn increases the amount of unburned substances ($H_2$, $CH_4$, and the like) present within the ash that affect the combustion efficiency. Furthermore, since the nitrogen components contained within the coal itself convert into nitrogen oxides $NO_x$ during combustion, the aforenoted combustion process contributes to a significant increase in nitrogen oxides $NO_x$ when compared with oil and gas fuels and their corresponding furnaces.

Therefore, during the operation of such boilers, sensors need to be installed at the outlet or within the flue of the furnace 14 so as to monitor the components of the exhaust gases. Any increase in the amount of unburned substances within the ash should be dealt with by reducing the grain size of the powdered coal by controlling the fine/coarse grain separator 13 so as to increase the combustion efficiency. In order to cope with an increase in the amount of nitrogen oxides $NO_x$, the two-stage combustion air ratio needs to be changed so as to lower the nitrogen oxides $NO_x$ emissions below the limit.

The amount of unburned substances remaining within the ash varies greatly depending upon the size of the coal grains burned within the burner 15. The finer the grain size, the greater the surface area by means of which the coal grains contact the air for combustion and the smaller the amount of unburned components within the ash. The nitrogen oxides $NO_x$ density also varies according to the grain size and kind of coal. On the other hand, the two-stage burning method for reducing the nitrogen oxides $NO_x$ emissions increases the amount of unburned substances since it lowers the in-furnace temperature. The control of the fine/coarse grain separator 13 that determines the grain size is subject to limitations imposed by means of the operating power of the pulverizing mill, which in turn varies according to the kind and amount of coal supplied and also according to the roller friction conditions.

In this way, the plant status characteristics including $NO_x$ the nitrogen oxides density, the unburned components within the ash the pulverizing mill power conditions, the two-stage combustion air ratio, and the control quantities of the fine/coarse grain separator all interfere with each other. Therefore, the optimum operation of the plant has currently or conventional required the skill and experience of a veteran operator.

OBJECT OF THE INVENTION

An object of the present invention is to control and operate the combustion furnace under stable conditions by inferring the necessary control quantities from the current operating state of the furnace so as to maintain the noxious substances such as, for example, the nitrogen oxides; $NO_x$ and the amount of unburned substances within the ash that affects the combustion efficiency, within optimum ranges.

SUMMARY OF THE INVENTION

The present invention provides a combustion control apparatus for a powdered coal-fired furnace which treats as fuzzy quantities density data of nitrogen oxides contained within the burning waste gases and unburned substances within the ash and power data of the pulverizing mill, qualitatively evaluates these fuzzy quantities, and performs a fuzzy logic upon the evaluation results so as to determine an optimal two-stage combustion air ratio for minimizing the nitrogen oxide emissions and to also control the fine/coarse grain separator so as to provide an optimal grain size of the coal for minimizing the amount of unburned substances within the ash of the exhaust gases.

In accordance with the combustion control apparatus of this invention, the density data of the nitrogen oxides contained within the burning waste gases and of the unburned substances contained within the ash, and the power data of the pulverizing mill are manipulated as fuzzy quantities which are then qualitatively evaluated by means of corresponding membership functions. From a group of control rules that determine a control output under certain conditions, a control rule that most matches the evaluated value is searched for and retrieved, and according to this rule a fuzzy logic is used to infer the optimal control quantities for the two-stage combustion air ratio and for the fine/coarse grain separator.

Based upon these optimal control quantities thus inferred, the air ratio for the two-stage combustion is controlled so as to reduce the amount of nitrogen oxides contained within the discharged gases, and the vane opening or revolution of the fine/coarse grain separator is controlled so as to change the grain size of the pulverized coal and thereby minimize the amount of unburned substances within the ash.

BRIEF DESCRIPTION OF THE DRAWINGS

Various other objects, features, and attendant advantages of the present invention will become more fully appreciated from the following detailed description, when considered in connection with the accompanying drawings, in which like reference characters designate like or corresponding parts throughout the several views, and wherein:.

DETAILED DESCRIPTION OF PREFERRED EMBODIMENT

Figure 1:
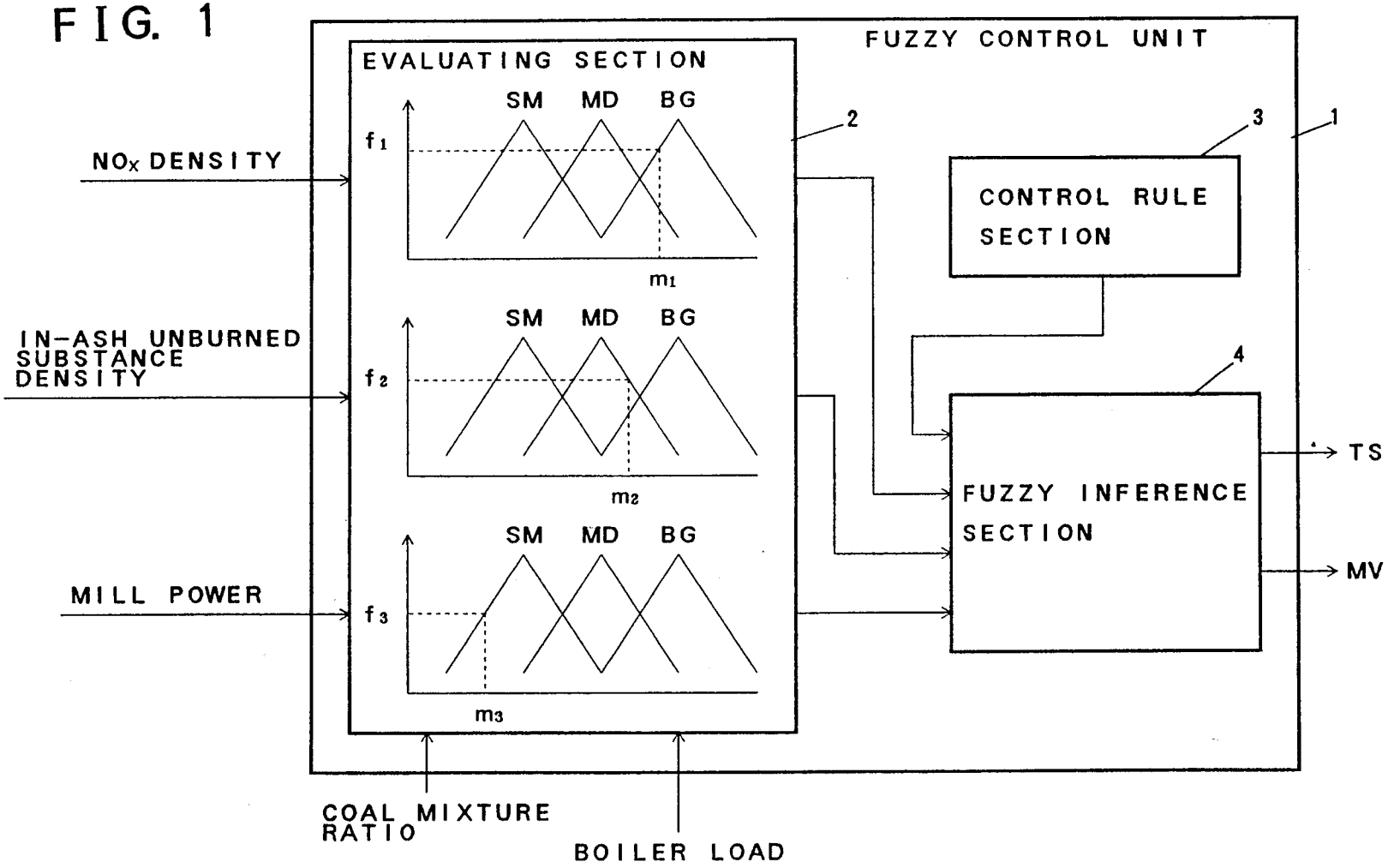
FIG. 1 is a block diagram of one embodiment of this invention.
Figure 3:
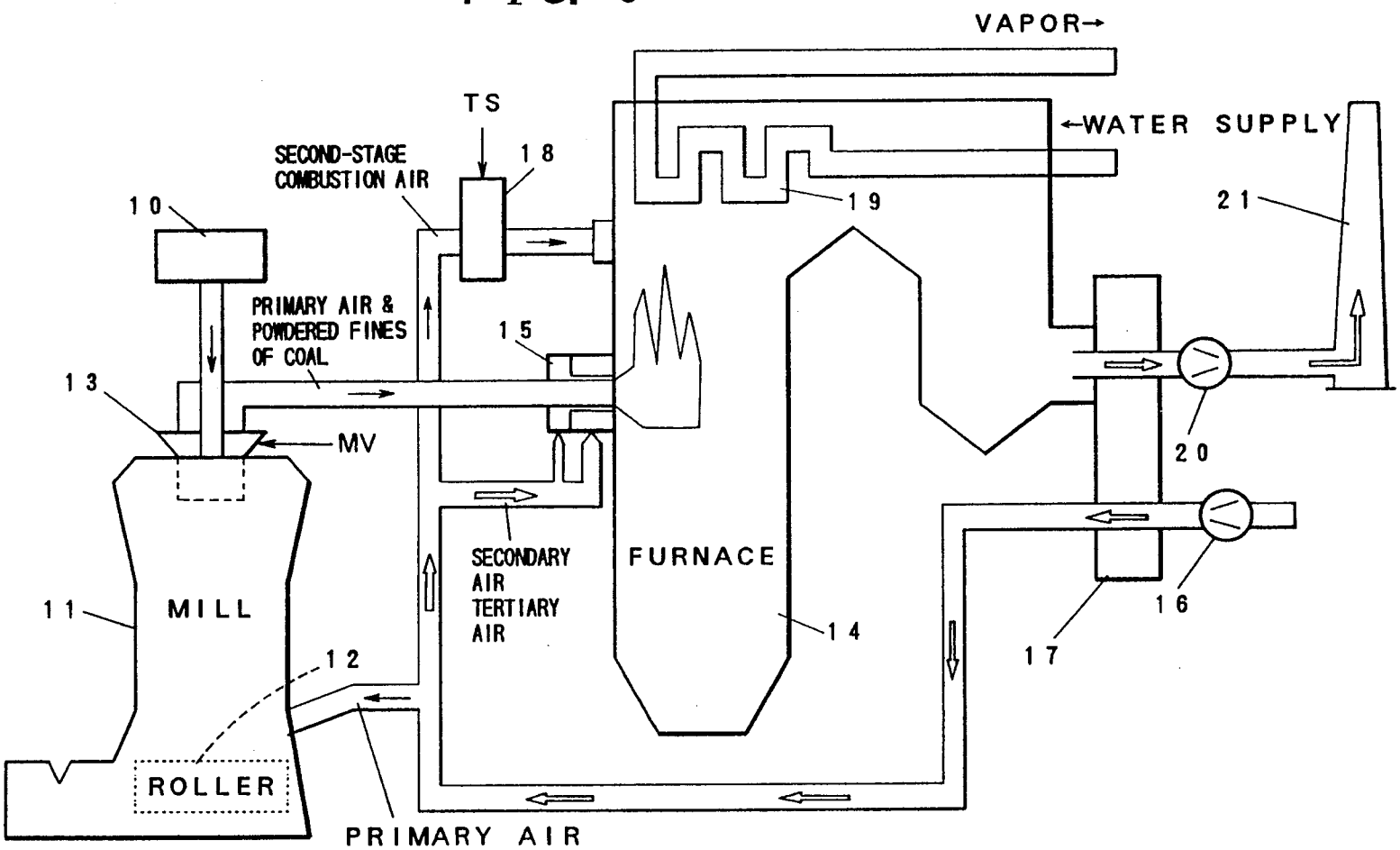
FIG. 3 is a schematic diagram showing the configuration of a generator boiler.

FIG. 1 is a block diagram showing one embodiment of a combustion control apparatus for a coal burning furnace according to this invention. This apparatus takes in the $NO_x$ nitrogen oxides density present within the exhaust gases and the density of the unburned substances within ash, and the power data of a pulverizing mill 11. A fuzzy control unit 1 determines, from this data received, optimal control quantities for the two-stage combustion air ratio and the fine/coarse grain separator 13 (FIG. 3) so as to achieve a nitrogen oxides; $NO_x$ density and an in-ash unburned substance density values which are within stable regions.

The nitrogen oxides $NO_x$ density data is received from a nitrogen oxides $NO_x$ density sensor. The in-ash unburned substance density data is calculated and inferred from such data as, for example the flame temperature and the amount of coal supplied to the burner (see, for example, Japanese Patent Preliminary Publication No. Heisei 2-208412). The mill power data is received from suitable sensors and normalized in accordance with the mill load.

The fuzzy control unit 1 comprises an evaluating section 2 which qualitatively evaluates input data by means of the corresponding membership functions; a control rule section 3 which has a group of predetermined control rules defining the control outputs under certain situations; and a fuzzy inference section 4 which searches through the control rule section 3 for a control rule that matches the evaluated value produced by means of the evaluating section 2 and then infers an optimal value for the control quantity.

The membership functions within the evaluating section 2 vary according to the coal mixture ratio and the boiler load. The control rules stored within the control rule section 3 are production rules prepared upon the basis of the knowledge and experience of skilled operators and in accordance with large database information accumulated to date. The production rules are described in the form of a statement consisting of an IF portion (a leading part of the statement) and a THEN portion (a concluding part of the statement).

Assuming that the nitrogen oxides $NO_x$ density NX is m1, the in-ash unburned substance density UM is m2, the mill power MP is m3, and that a rule is "If NX=BG, UM=MD, and MP=SM Then TS=BG and MV=MD," it is possible to determine, from each membership function within the evaluating section 2, the extent f1, f2, f3 to which this rule is satisfied. In the membership functions the symbols SM, MD and BG stand for "small," "middle" and "big."

Figure 2A:
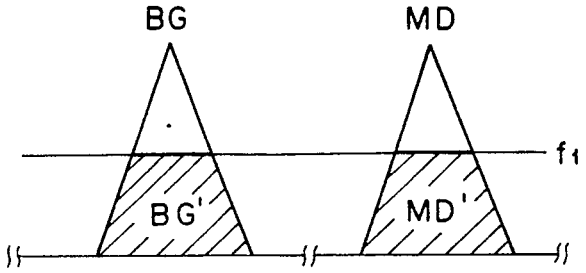
FIGS. 2*a*-2*c* are diagrams showing the process of inference using fuzzy reasoning.

The fuzzy inference section 4 employs a "max-min logical product method" as an inference method, whereby the minimum f1 of the extent or degrees f1 to f3 is chosen and the logical product is derived in connection with a flat membership function of the minimum value f1 and the membership function of TS=BG in the concluding part of the statement. Turning to the illustrations of FIG. 2, the membership function BG in the concluding part of the statement is truncated so as to obtain the function of valve BG'. Similarly, MD' is determined for the membership function MV=MD in the concluding part (FIG. 2*a*).

Figure 2B:
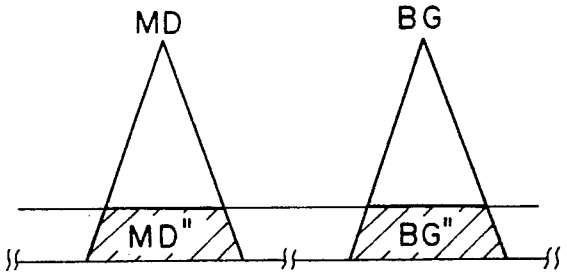
Figure 2C:
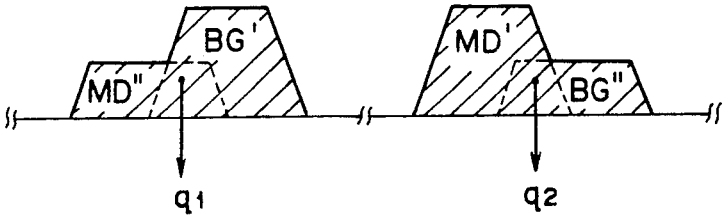

For other rules, similar operations are carried out so as to obtain MD'' and BG'' (FIG. 2*b*). Then a logical summation is taken of BG' and MD'' and of MD' and BG''. According to the center-of-gravity method, the center of gravity is determined for each figure (FIG. 2*c*) and now values q1 and q2 of the gravity centers within the two sets represent the final outputs TS and MV.

Using the output TS thus obtained, the two-stage combustion air damper 18 is so as to control the two-stage combustion air ratio. The output MV is used to control the vane opening or revolution of the separator 13. These controls are performed in ways that will maintain the nitrogen oxides $NO_x$ density within the burning waste gases and the in-ash unburned substance density within the stable regions or range.

With this invention, the two-stage combustion air ratio and the fine/coarse grain separator control amount are qualitatively determined with high precision by means of the fuzzy inference, making it possible to maintain within the appropriate ranges the density of the nitrogen oxides $NO_x$ contained within the exhaust gases and the density of the unburned substances contained within the ash. Therefore, the coal-fired furnace can be operated and controlled safely and efficiently.

Obviously, many modifications and variations of the present invention are possible in light of the above teaching. It is therefore to be understood that within the scope of the appended claims, the present invention may be practiced otherwise than as specifically described herein.

What is claimed is:

1. In a powdered coal combustion furnace in which coal is pulverized by means of a pulverizing mill, and wherein only powdered coal whose grain size is less than a predetermined value is extracted by means of a fine/coarse grain separator, and wherein further said extracted powdered coal is fired within said combustion furnace, a combustion control apparatus for said coal-fired furnace is provided for performing a control process which comprises the steps of:

qualitatively evaluating as fuzzy quantities the density data of nitrogen oxides contained within burning exhaust gases, and the density data of unburned substances within ash, and power data of said pulverizing mill; and according to the results of said evaluation step, inferring and controlling a two-stage combustion air ratio at an optimal value for minimizing nitrogen oxide emissions, and inferring and controlling said fine/coarse grain separator so as to extract said powdered coal of an optimal grain size for minimizing the amount of unburned substance within said ash.

2. In a powdered coal combustion furnace in which coal is pulverized by means of a pulverizing mill, and wherein only powdered coal whose grain size is less than a predetermined value is extracted by means of a fine/coarse grain separator, and wherein further said extracted powdered coal is fired within said combustion furnace, a combustion control apparatus for said coal-fired furnace, comprising:

an evaluating means for qualitatively evaluating density data of nitrogen oxides contained within burning exhaust gases, density data of unburned substances within ash, and power data of said pulverizing mill by using membership functions corresponding to said different data;

a control rule means containing control rules which define generating control outputs under predetermined situations; and a fuzzy inference means for searching said control rule means for a control rule that matches an evaluated value produced by said evaluating means and, according to said control rule, infers an optimum control amount for a two-stage combustion air ratio for minimizing said nitrogen oxides within said exhaust gases, and an optimum control amount for said fine/coarse grain separator for minimizing said unburned substances within said ash;

whereby based upon said optimum control amounts thus inferred, the furnace combustion conditions are optimally controlled so as to maintain said densities of said nitrogen oxides and of said in-ash unburned substances within safe, stable ranges.

* * * * *